US010698345B2

(12) United States Patent
Mimura et al.

(10) Patent No.: US 10,698,345 B2
(45) Date of Patent: Jun. 30, 2020

(54) IMAGE FORMING APPARATUS

(71) Applicant: KYOCERA Document Solutions Inc., Osaka (JP)

(72) Inventors: Daisuke Mimura, Osaka (JP); Hiromu Matsumoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 462 days.

(21) Appl. No.: 15/588,940

(22) Filed: May 8, 2017

(65) Prior Publication Data

US 2017/0351199 A1 Dec. 7, 2017

(30) Foreign Application Priority Data

Jun. 6, 2016 (JP) ..... 2016-112424

(51) Int. Cl.
*G03G 15/16* (2006.01)
*G03G 21/16* (2006.01)

(52) U.S. Cl.
CPC ..... *G03G 15/1605* (2013.01); *G03G 21/168* (2013.01); *G03G 21/1671* (2013.01); *G03G 2221/1654* (2013.01); *G03G 2221/1869* (2013.01)

(58) Field of Classification Search
None
See application file for complete search history.

(56) References Cited

U.S. PATENT DOCUMENTS 9,400,480 B2 7/2016 Itabashi
2009/0214235 A1* 8/2009 Hattori ..... G03G 21/1864 399/37
2011/0116831 A1* 5/2011 Honobe ..... G03G 15/161 399/110

FOREIGN PATENT DOCUMENTS

JP 2015-157381 A 9/2015
JP 2016-004113 A 1/2016

* cited by examiner

*Primary Examiner* — Roy Y Yi
(74) *Attorney, Agent, or Firm* — Studebaker & Brackett PC

(57) ABSTRACT

An image forming apparatus includes a drum unit, a process frame, a lock member and an intermediate transferring unit. The drum unit rotatably supports a rotating shaft of a photosensitive drum. The process frame has an attachment part to which the drum unit is attached. The lock member positions the drum unit to the attachment part. The intermediate transferring unit is attached to the process frame after the drum unit is attached. The lock member has a supporting part, an engagement part and a restriction part. Though the supporting part, an end of the rotating shaft is passed. The engagement part is engaged with the process frame between the process frame and the intermediate transferring unit. The restriction part interferes with the intermediate transferring unit between the engagement part and the intermediate transferring unit to prevent the engagement part from being detached from the process frame.

15 Claims, 9 Drawing Sheets

IMAGE FORMING APPARATUS

INCORPORATION BY REFERENCE

This application is based on and claims the benefit of priority from Japanese Patent application No. 2016-112424 filed on Jun. 6, 2016, which is incorporated by reference in its entirety.

BACKGROUND

The present disclosure relates to an image forming apparatus including a processing unit to which a drum unit having a photosensitive drum is detachably attached.

Some of an image forming apparatus, such as a copying machine and a printer, have a configuration in which a processing unit is detachably attached to an apparatus main body. Into the processing unit, a drum unit, a development unit and an intermediate transferring unit are integrated. The drum unit supports a photosensitive drum so as to be rotatable. The development unit supports a development device. The intermediate transferring unit supports an intermediate transferring belt so as to be rotatable.

The processing unit of an example of the image forming apparatus is configured such that the drum unit, the development unit and the intermediate transferring unit are positioned and supported between two coupling members. Each unit has positioning projections while the two coupling members has positioning holes with which the positioning projections are engaged. By these positioning projections and positioning holes, these units are positioned relatively to each other.

However, the above image forming apparatus requires a disassembling work of the processing unit at maintenance and replacement of each unit. This lowers workability.

The processing unit of another example of the image forming apparatus is configured such that the drum unit and the development unit are detachably supported to a square cylindrical shaped process frame. The image forming apparatus is provided with a lock member which supports each of both ends of a rotating shaft of the photosensitive drum. The lock member is configured to be engaged with the process frame.

In the above configuration, if a gap between the photosensitive drum and the process frame in a direction of the rotating shaft becomes narrow as the image forming apparatus is reduced in size, a length of a portion where the lock member and the process frame are engaged with each other becomes small. Then, the lock member may be easily detached from the process frame, and therefore it becomes difficult to position the drum unit stably.

SUMMARY

In accordance with an aspect of the present disclosure, an image forming apparatus includes a drum unit, a process frame, a lock member and an intermediate transferring unit. The drum unit rotatably supports a rotating shaft of a photosensitive drum. The process frame has an attachment part to which the drum unit is attached. The lock member positions the drum unit to the attachment part. The intermediate transferring unit is attached to the process frame after the drum unit is attached. The lock member has a supporting part, an engagement part and a restriction part. Though the supporting part, an end of the rotating shaft is passed. The engagement part is engaged with the process frame between the process frame and the intermediate transferring unit. The restriction part interferes with the intermediate transferring unit between the engagement part and the intermediate transferring unit to prevent the engagement part from being detached from the process frame.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus according to an embodiment of the present disclosure will be described.

Figure 1:
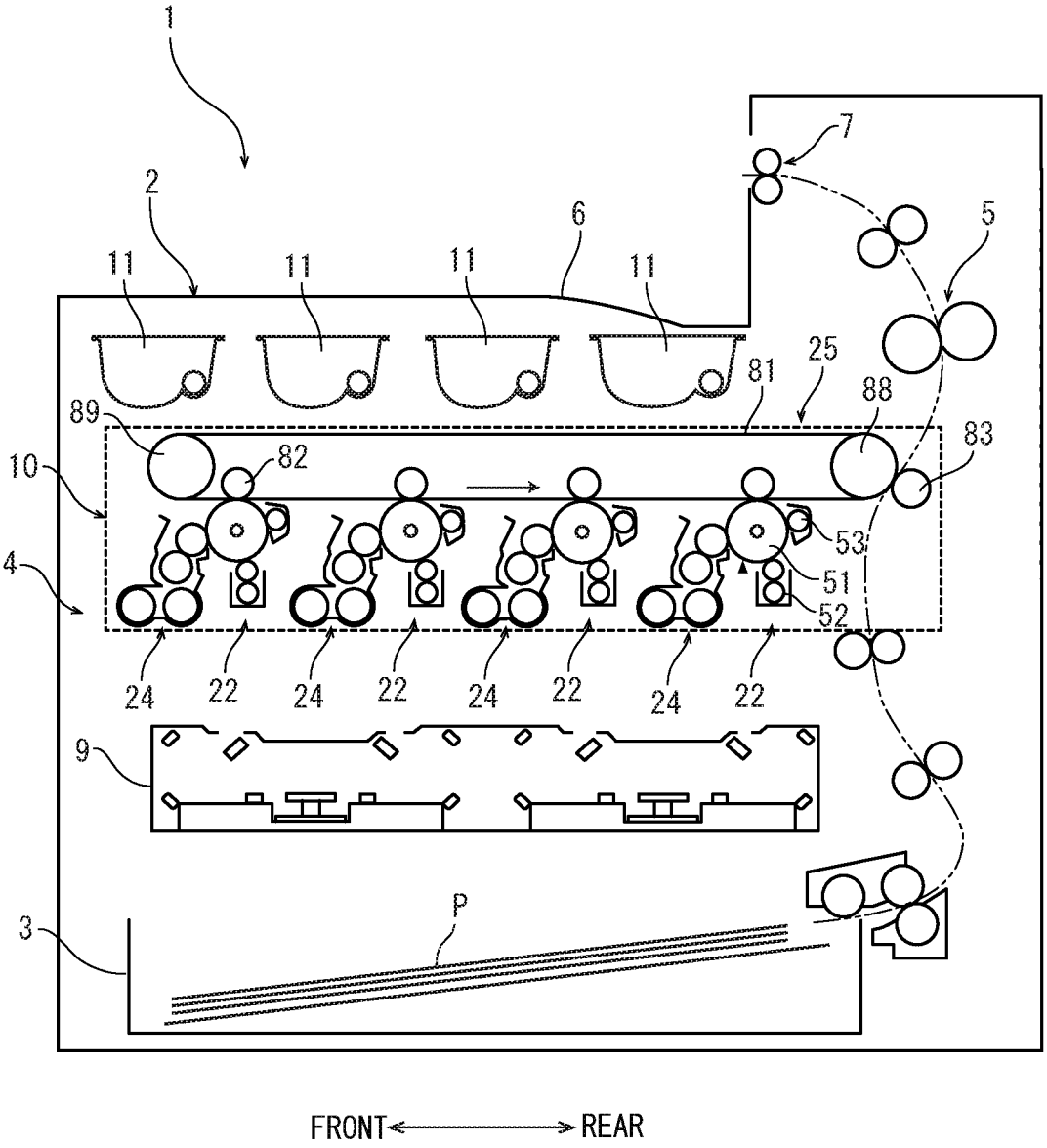
FIG. 1 is a sectional view schematically showing an inner structure of a color printer according to an embodiment of the present disclosure.

With reference to FIG. 1, a color printer 1 as an image forming apparatus will be described. FIG. 1 is a view schematically showing an inner structure of the color printer 1. In the following description, a left side of the paper plan of FIG. 1 is set as a front side of the color printer 1, and left and right directions are based on a direction in which the color printer 1 is seen from the front side.

An apparatus main body 2 of the color printer 1 is provided with a sheet feeding cassette 3, an image forming part 4, a fixing device 5 and an ejection device 7. The sheet feeding cassette 3 stores sheets P. The image forming part 4 forms a full color toner image on the sheet P. The fixing device 5 fixes the toner image on the sheet P. The ejection device 7 ejects the sheet P having the fixed toner image on an ejection tray 6. The sheet P is fed from the sheet feeding cassette 3. Then, after a full color toner image is formed on the sheet P at the image forming part 4, the full color toner image is fixed on the sheet P by the fixing device 5 and then the sheet P is ejected on the ejection tray 6 by the ejection device 7.

The image forming part 4 includes an exposing device 9, a processing unit 10 and four toner containers 11 respectively containing toner of four colors (yellow, magenta, cyan and black).

Figure 2:
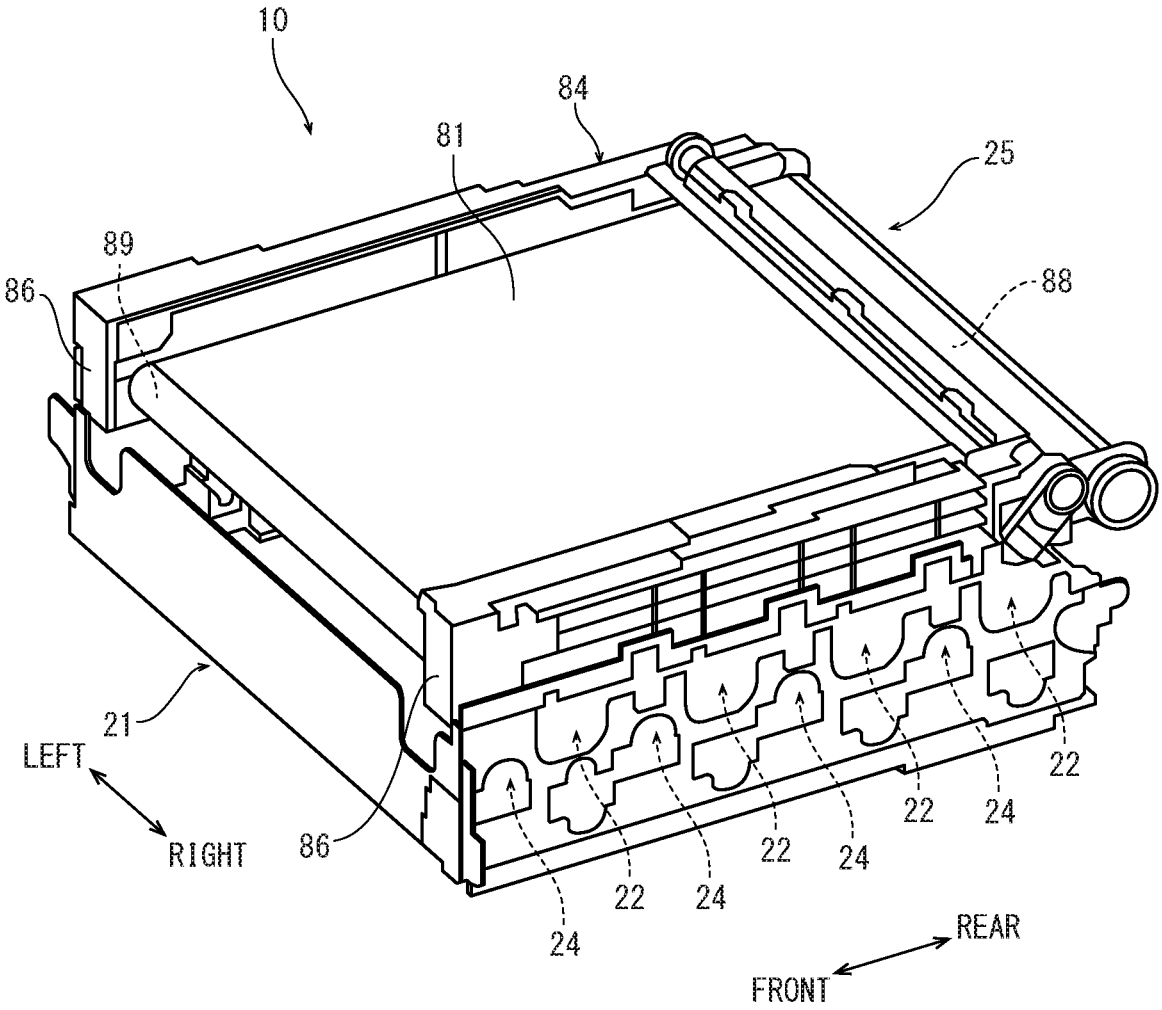
FIG. 2 is a perspective view showing a processing unit of the color printer according to the embodiment of the present disclosure.
Figure 4:
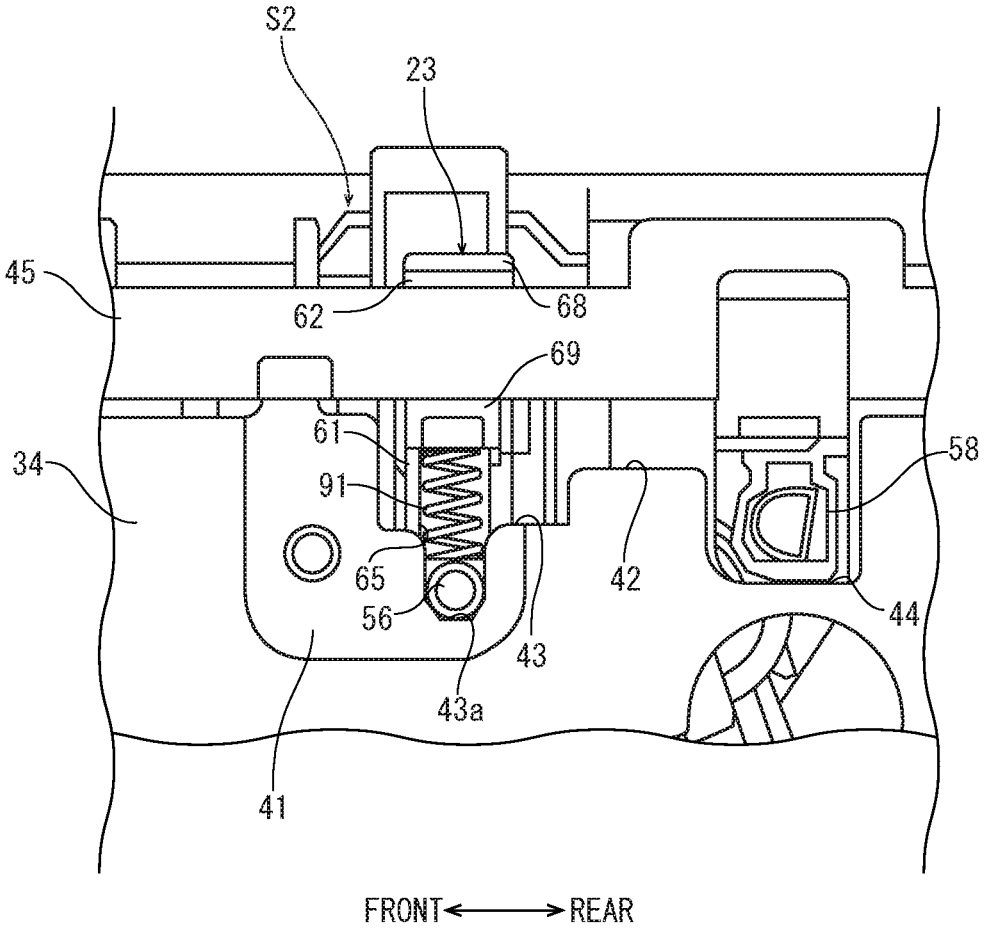
FIG. 4 is a side view showing a drum unit attached to a drum unit attachment part, in the color printer according to an embodiment of the present disclosure.
Figure 5:
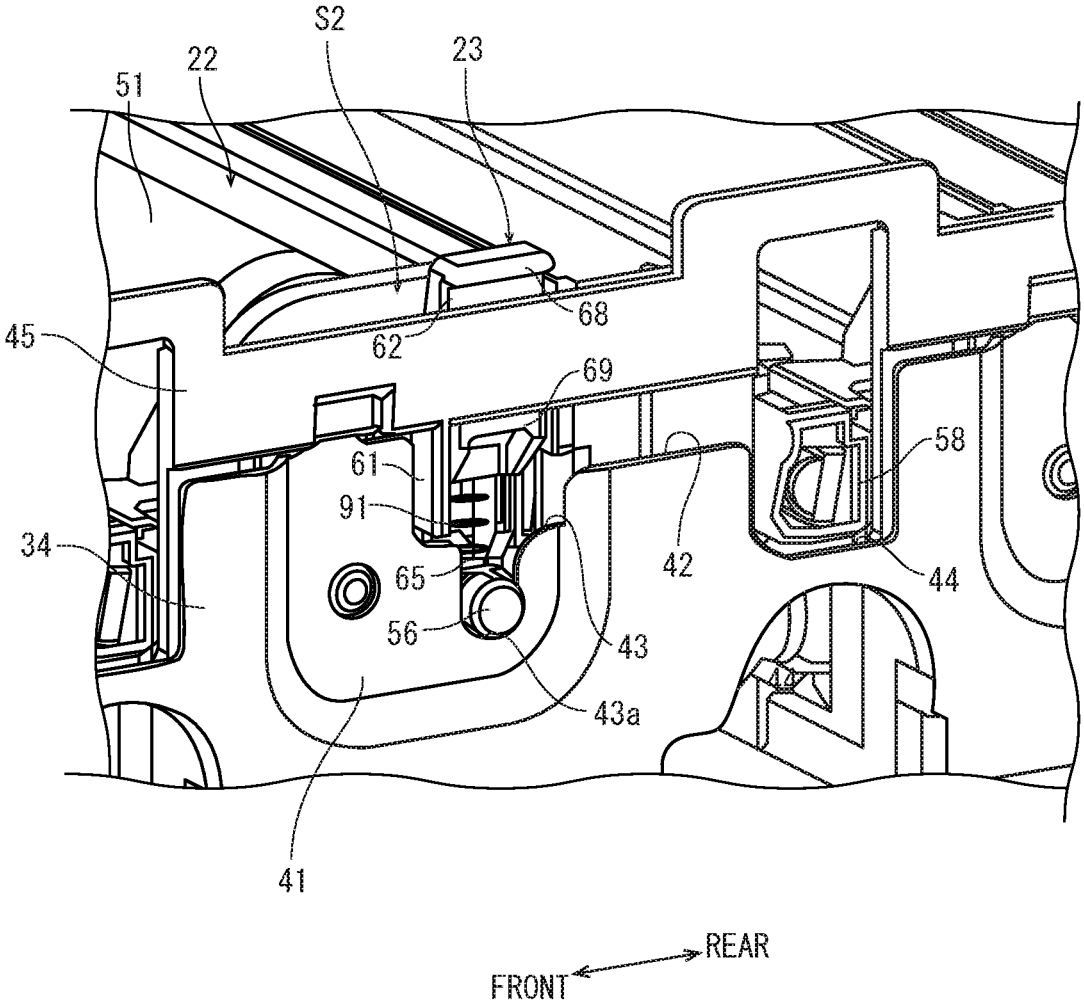
FIG. 5 is a perspective view showing the drum unit attached to the drum unit attachment part, in the color printer according to the embodiment of the present disclosure.
Figure 6:
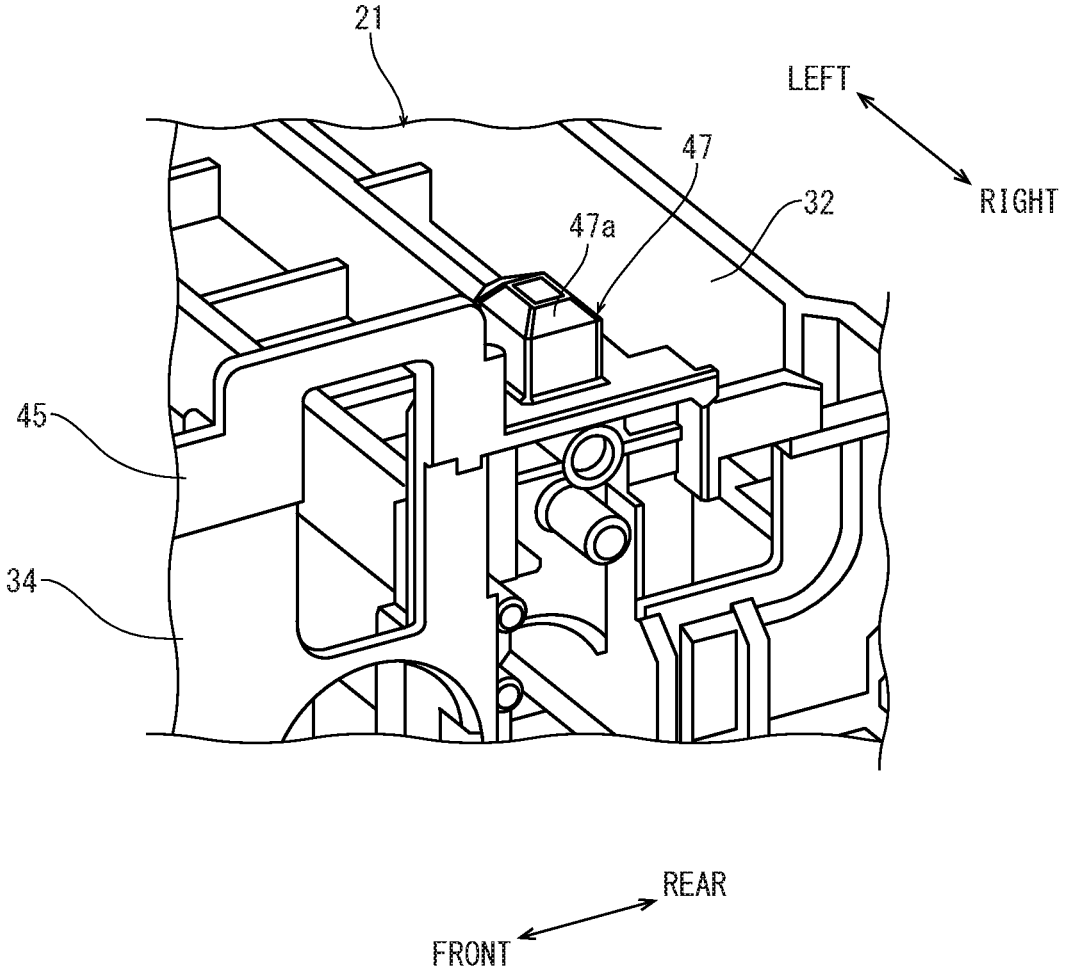
FIG. 6 is a perspective view showing a positioning projection formed in the process frame, in the color printer according to the embodiment of the present disclosure.

Next, with reference to FIG. 2 to FIG. 6, the processing unit will be described. FIG. 2 is a perspective view showing the processing unit (a development unit and a drum unit are not shown), FIG. 3 is a perspective view showing a process frame, FIG. 4 is a front view showing the drum unit attached to a drum unit attachment part, FIG. 5 is a perspective view showing the drum unit attached to the drum unit attachment part and FIG. 6 is a perspective view showing a positioning projection.

As shown in FIG. 2, the processing unit 10 includes a process frame 21, four drum units 22 (refer to FIG. 1, not shown in FIG. 2), four pairs of lock members 23 (refer to FIG. 4 and FIG. 5, not shown in FIG. 2), four development units 24 (refer to FIG. 1, not shown in FIG. 2) and an intermediate transferring unit 25. The four drum units 22 corresponding to the four colors of the toner are detachably attached to the process frame 21. The pair of lock members 23 is configured to position each drum unit 22 to the process frame 21. The four development units 24 corresponding to the four colors of the toner are detachably attached to the process frame 21. The intermediate transferring unit 25 is detachably attached to the process frame 21 above the drum units 22 and the development units 24.

Figure 3:
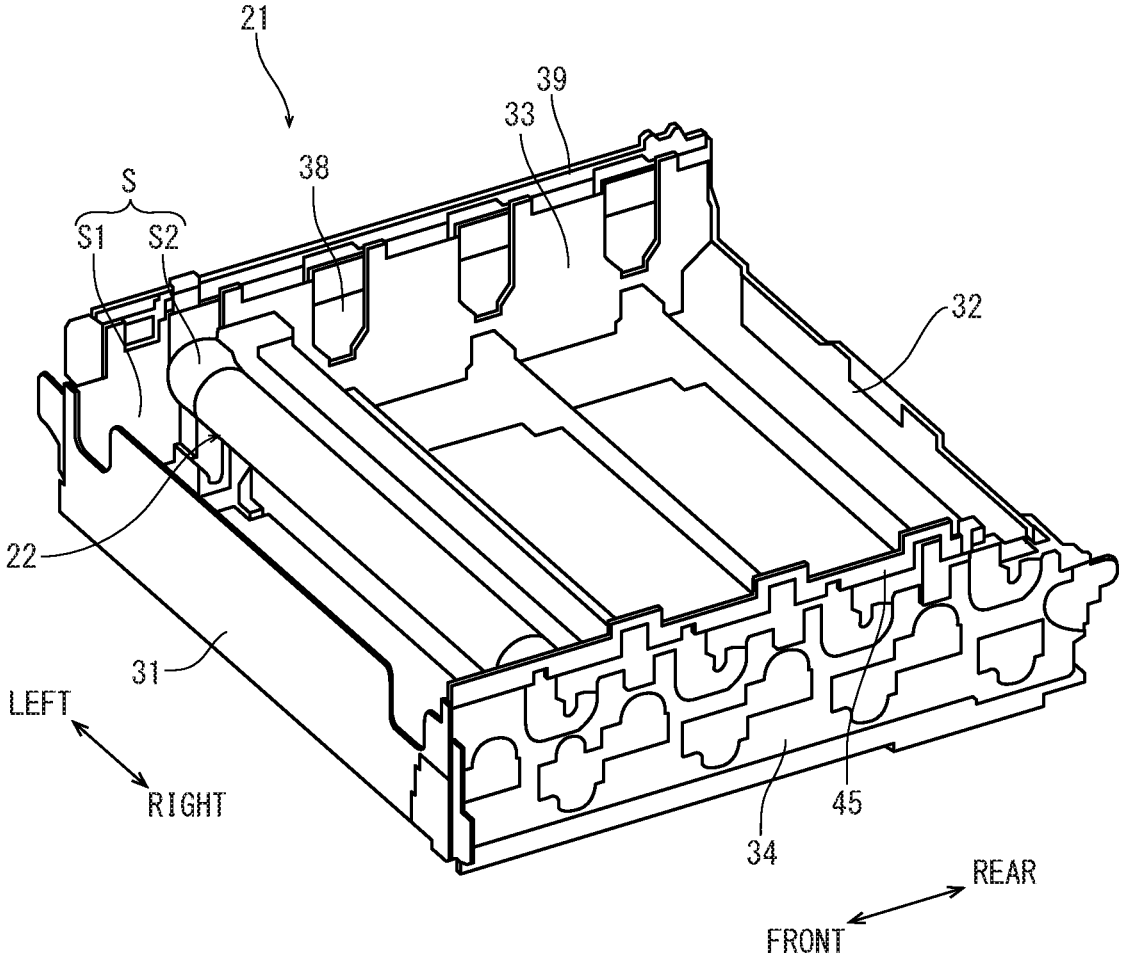
FIG. 3 is a perspective view showing a process frame of the color printer according to the embodiment of the present disclosure.

As shown in FIG. 3, the process frame 21 has front and rear side plates 31 and 32 opposing to each other in the front and rear directions and left and right side plates 33 and 34 opposing to each other in the left and right directions, and is formed into a square cylindrical shaped frame member. In the process frame 21, four attachment parts S are arranged side by side in the front and rear directions. Each attachment part S has a development unit attachment part S1 and a drum unit attachment part S2 which are arranged side by side in the front and rear directions.

In each drum unit attachment part S2, the left side plate 33 has a flange receiving part 38. The flange receiving part 38 is formed by cutting out the left side plate 33 downward from the upper edge. The flange receiving part 38 has a rectangular shape of which lower end is formed into an inverse trapezoidal shape tapered downward. Along an upper edge of an outer face of the left side plate 33, a left engagement plate 39 is fixed.

As shown in FIG. 4 and FIG. 5, in each drum unit attachment part S2, the right side plate 34 has a recessed part 41 and a cutout part 42. The recessed part 41 is formed by recessing the right side plate 34 inward into a rectangular shape. The cutout part 42 is formed by cutting out the right side plate 34 downward from the upper edge at the rear side of the recessed part 41. In the cutout part 42, a front side cutout 43 and a rear side cutout 44 are formed. The front side cutout 43 is formed by cutting out the right side plate 34 downward from a front end portion of a lower edge of the cutout part 42. The rear side cutout 44 is formed by cutting out the right side plate 34 downward from a rear end portion of the lower edge of the cutout part 42. The front side cutout 43 has a positioning portion 43*a* formed by cutting out the right side plate 34 downward from the lower edge. The positioning portion 43*a* is formed into an inverse trapezoidal shape tapered downward. To the positioning portion 43*a*, a rotating shaft 56 of the photosensitive drum 51 is positioned. Along an upper edge of an outer face of the right side plate 34, a right engagement plate 45 is fixed.

As shown in FIG. 6, on a right and rear corner of the process frame 2*l*, a positioning projection 47 is protruded upward. The positioning projection 47 is configured to position the intermediate transferring unit 25. The positioning projection 47 has a square cylindrical shape, and has a tip portion 47*a* tapered upward.

Figure 7:
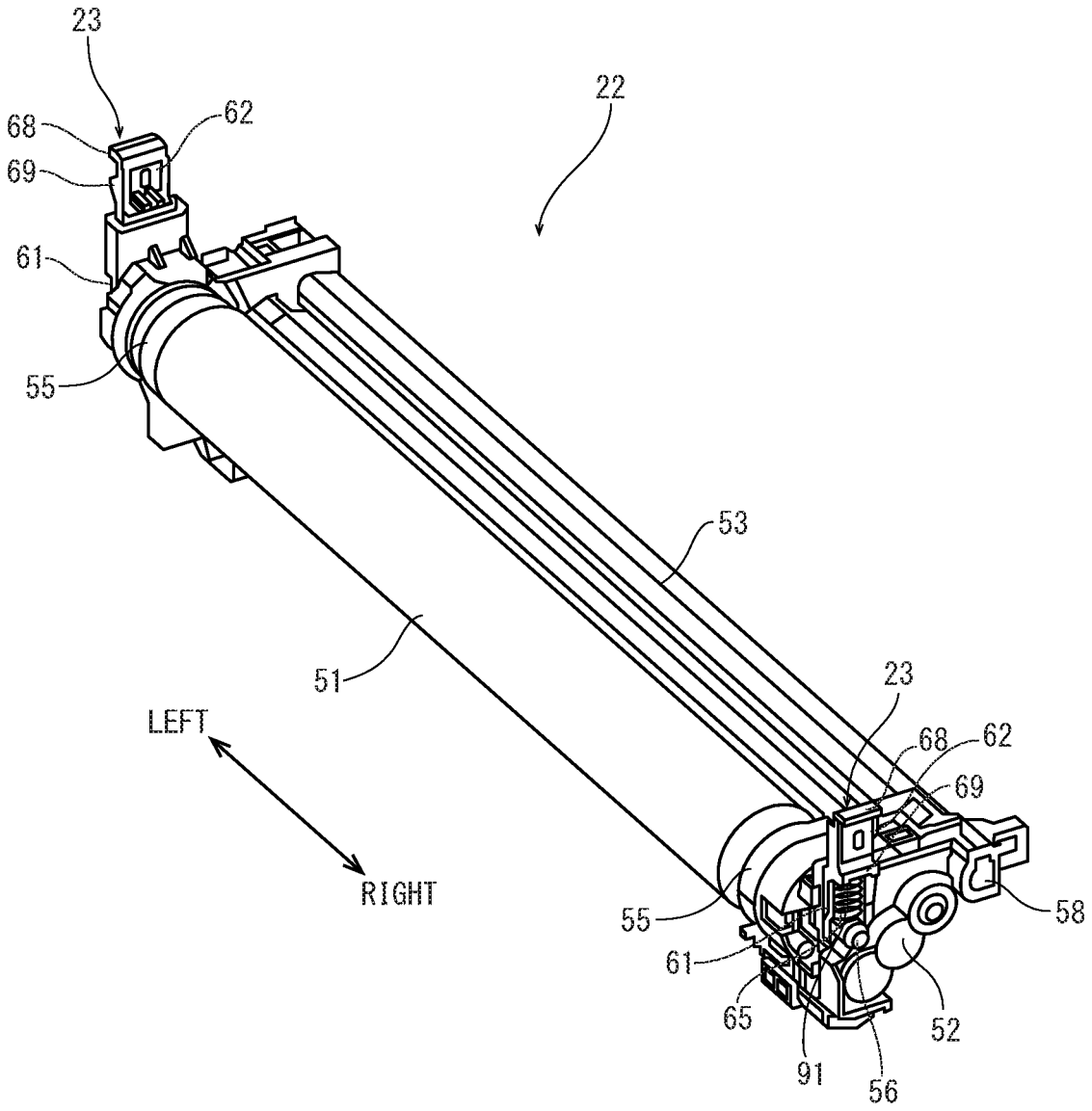
FIG. 7 is a perspective view showing the drum unit of the color printer according to the embodiment of the present disclosure.

Next, with reference to FIG. 7, the drum unit 22 will be described. FIG. 7 is a perspective view showing the drum unit.

The drum unit 22 includes a photosensitive drum 51 on which an electric latent image is formed, a charging device 52 which charges the photosensitive drum 51 and a cleaning device 53 which removes the toner remained on the photosensitive drum 51. Into both openings of the photosensitive drum 51, flange members 55 are fixed. Between centers of the both flange members 55, a rotating shaft 56 is penetrated. The photosensitive drum 51 rotates around the rotating shaft 56. The charging device and the cleaning device 53 are arranged around the photosensitive drum 51 in a rotating direction of the photosensitive drum 51 in the order. On a right side face of the cleaning device 53, a positioning protruding 58 is formed so as to protrude in a direction parallel with an axis direction of the rotating shaft 56.

Figure 8A:
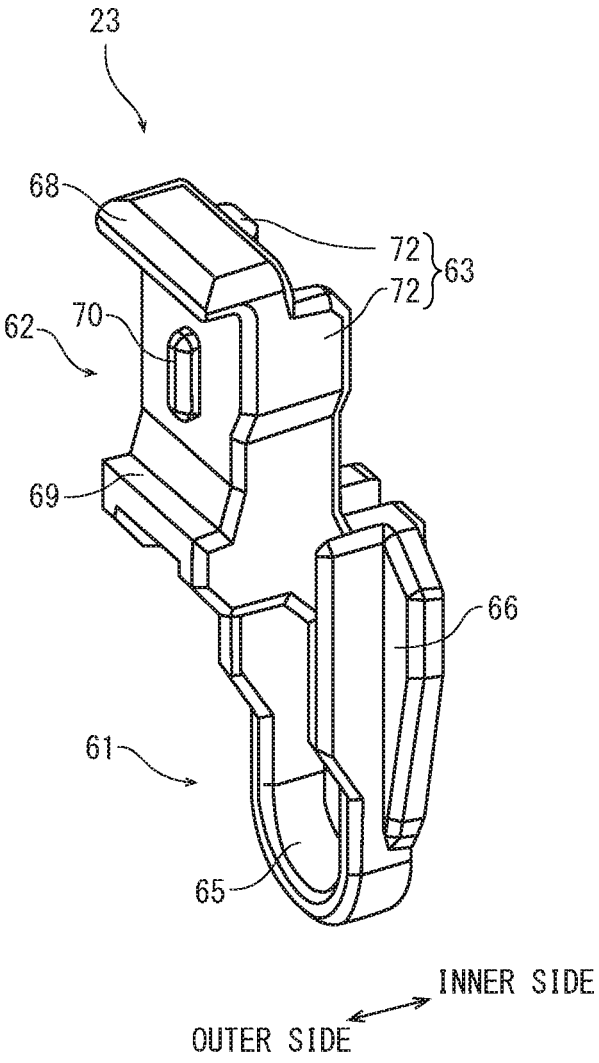
FIG. 8A is a perspective view showing a lock member, viewed from an outer side, of the color printer according to the embodiment of the present disclosure.
Figure 8B:
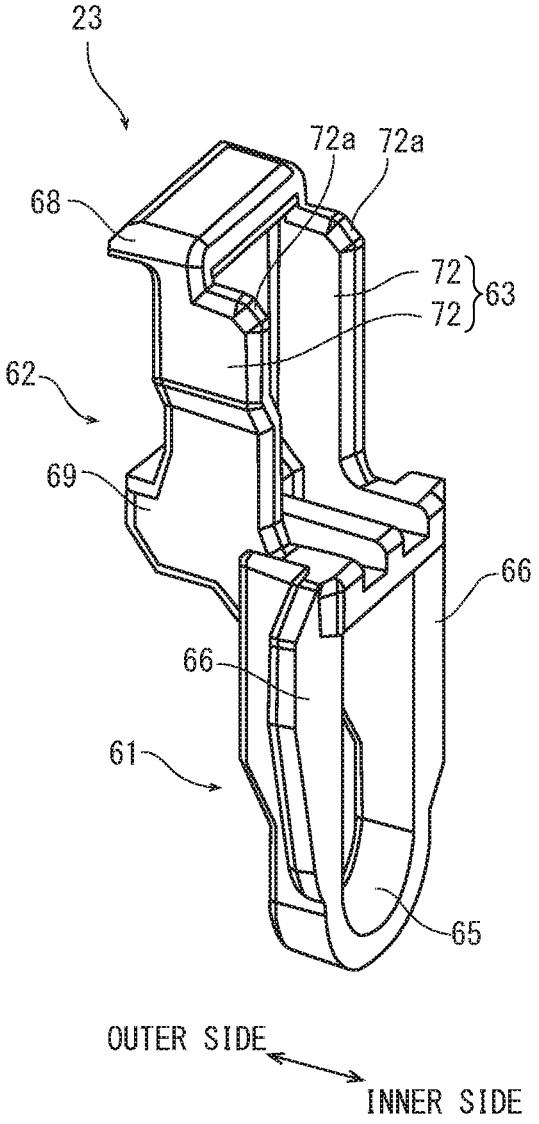
FIG. 8B is a perspective view showing the lock member, viewed from an inner side, of the color printer according to the embodiment of the present disclosure.

Next, with reference to FIG. 8A and FIG. 8B, the lock member 23 will be described. FIG. 8A and FIG. 8B are perspective views showing the lock member. In the following description, an inner direction (an inner side) and an outer direction (an outer side) respectively show a direction toward an inner side of the processing unit 10 and a direction toward an outer side of the processing unit 10 in the axis direction of the rotating shaft 56.

The lock member 23 is a member configured to attach the drum unit 22 to the process frame 21, as described above. The lock member 23 has a lower supporting part 61, an upper engagement part 62 and a restriction part 63 provided on the engagement part 62.

The supporting part 61 is formed into a cylindrical shape having a U-shaped front view. The supporting part 61 has an axis hole 65 through which one end of the rotating shaft 56 is capable of being passed. From inner side ends of both side faces of the supporting part 61, a pair of flange portions 66 extends in opposing directions in a direction perpendicular to the axis direction of the rotating shaft 56.

The engagement part 62 is formed into a plate piece having a rectangular front shape. The engagement part 62 extends upward from an outer side end of the upper face of the supporting part 61. On an outer face of the engagement part 62, an upper claw 68 and a lower claw 69 which are in parallel are protruded outward at a predetermined interval in the vertical direction. A distance between the upper and lower claws 68 and 69 is slightly wider than a width of the left and right engagement plates 39 and 45. The upper claw 68 has a rectangular plate shape in which corners between an upper face and four side faces are tapered. The lower claw 69 has an inclined portion inclined outward in a lower oblique direction and a horizontal portion extending horizontally from a tip end of the inclined portion. On the outer face of the engagement part 62, a vertical long projection 70 is protruded between the upper and lower claws 68 and 69. The projection 70 is configured to come into contact with an inner face of each of the left and right engagement plates 39 and 45 to keep a posture of the restriction part 63 constant.

The restriction part 63 has a pair of vertical ribs 72 protruding inward from both side edges of the inner face of the engagement part 62. Each of the vertical ribs 72 has a vertical long rectangular shape. At an upper corner of each rib 72, a tapered face 72*a* is formed. The tapered face 72*a* is acted as a guide part which guides the intermediate transferring unit 25 to the process frame 21.

With reference to FIG. 1 and FIG. 2 again, the development unit 24 and the intermediate transferring unit 25 will be described. The development unit 24 includes a development device which develops the electric latent image formed on the photosensitive drum 51 with the toner.

The intermediate transferring unit 25 includes an endless intermediate transferring belt 81, four first transferring rollers 82 disposed in a hollow space of the intermediate transferring belt 81 and a frame 84 to which the intermediate transferring belt 81 and the four first transferring rollers 82 are supported.

The frame 84 has a pair of side plates 86 opposing to each other in the left and right directions, as shown in FIG. 2. Between one end portions on the pair of side plates 86, a drive roller 88 is rotatably supported. Between the other end portions of the pair of side plates 86, a driven roller 89 is rotatably supported. The frame 84 has a positioning recess (not shown) capable of engaging with the positioning projection 47 (refer to FIG. 6) of the process frame 21.

The intermediate transferring belt 81 is bridged between the drive roller 88 and the driven roller 89, and circulates by rotating of the drive roller 88. The four first transferring rollers 82 are arranged along a lower side inner face of the intermediate transferring belt 81 at predetermined intervals in the front and rear directions, and rotatably supported by the pair of side plates 86. As shown in FIG. 1, the second transferring roller 83 is supported by the apparatus main body 2 so as to face the drive roller 88 via the intermediate transferring belt 81.

In the processing unit 10, after the charging device 52 charges the photosensitive drum 51 of the drum unit 22, the exposing device 9 exposes the photosensitive drum 51 to form an electric latent image on the photosensitive drum 51. The electric latent image is developed into a toner image by the development device of the development unit 24. The toner image is transferred on the intermediate transferring belt 81 from the photosensitive drum 51 by the first transferring roller 82 of the intermediate transferring unit 25. The four toner images formed by the four drum units 22 and the four development units 24 are transferred on the intermediate transferring belt 81 to form a full color toner image on the intermediate transferring belt 81. The full color toner image is transferred on the sheet from the intermediate transferring belt 81 by the second transferring roller 83. The toner remained on the photosensitive drum 51 is removed by the cleaning device 53. The sheet on which the full color toner image is transferred is conveyed to the fixing device 5, and the full color toner image is fixed on the sheet. The sheet is ejected by the ejection device 7 on the ejection tray 6.

Figure 9:
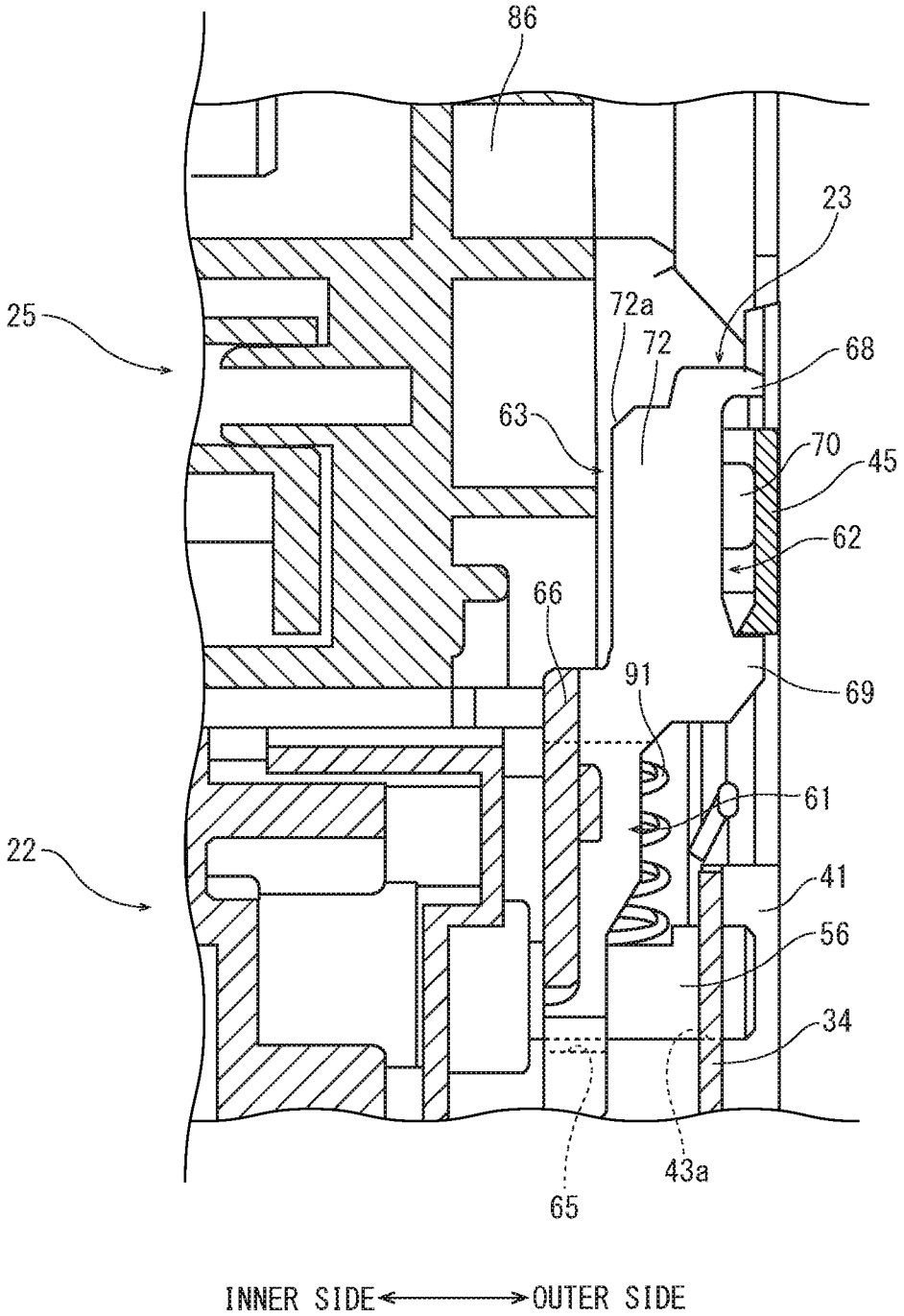
FIG. 9 is a side sectional view showing the lock member engaged with the process frame, in the color printer according to the embodiment of the present disclosure.

In the processing unit 10 having the above described configuration, a process for attaching the drum unit 22 to the process frame 21 by using the lock member 23 and then attaching the intermediate transferring unit 25 to the process frame 21 will be described with reference to FIG. 4 to FIG. 8, and FIG. 9. FIG. 9 is a sectional view showing the lock member engaged with the process frame. A description of a process for attaching the development unit 24 to the process frame 21 is omitted.

First, by using the pair of lock members 23, the drum unit 22 is attached to the process frame 21. As shown in FIG. 7, the lock members 23 are held with the upper and lower claws 68 of the engagement part 62 directed outward. Then, the both end portions of the rotating shaft 56 of the photosensitive drum 51 are made to be passed through the axis holes 65 of the supporting parts 61, and the pair of flange portions 66 is brought into contact with outer faces of the flange members 55 of the drum unit 22. Then, between the lower claw 69 and a cut portion formed on the end portion of the rotating shaft 56, a coil spring 91 as a biasing member is made to be interposed. The coil spring 92 biases the rotating shaft 56 downward with respect to the lower claw 69.

After that, while holding each engagement part 62 of the pair of lock members 23 with the fingers, the drum unit 22 is fitted into the drum unit attachment part S2 from the above side. Because the pair of flange portions 66 of the lock member 23 comes into contact with the outer faces of the flange members 55 of the drum unit 22 on both sides of the rotating shaft 56, the lock member 23 is prevented from being deviated. Then, the left flange member 55 of the drum unit 22 is fitted into the flange receiving part 38 (refer to FIG. 3) of the left side plate 33 so that an outer circumferential face of the flange member 55 comes into contact with both side edges of the tapered lower end of the flange receiving part 38.

On the other hand, as shown in FIG. 4 and FIG. 5, the right end portion of the rotating shaft 56 of the photosensitive drum 51 is fitted into the positioning portion 43*a* of the front side cutout 43 through the cutout part 42 of the right side plate 34. In addition, the positioning projection 58 of the cleaning device 53 is positioned to the rear side cutout 44 through the cutout part 42 of the right side plate 34.

Then, as shown in FIG. 9, each of the left and right engagement plates 39 and 45 gets into a space between the upper and lower claws 68 and 69 of the engagement part 62 of the lock member 23. In addition, the lower claw 69 is caught by a lower edge of each of the left and right engagement plates 39 and 45 so that the lock member 23 is prevented from being moved in the vertical direction. Thereby, the rotating shaft 56 is biased by the coil spring 91 to reach the positioning portion 43*a*. Because the positioning portion 43*a* has an inverse trapezoidal shape tapered downward, an outer circumferential face of the rotating shaft 56 come into contact with both side edges and a lower edge of the positioning portion 43*a* so that the rotating shaft 56 is positioned in the front and rear direction and in the vertical direction. Thereby, the drum unit 22 is positioned to the process frame 21.

Here, the development unit 24 has been attached to the development unit attachment part S1 of the attachment part S of the process frame 21 before the drum unit 22 is attached to the drum unit attachment part S2.

Finally, the intermediate transferring unit 25 is attached to the process frame 21 from the above side of the drum units 22 and the development units 24. In this time, when lower edges of the pair of side plates 86 of the intermediate transferring unit 25 come into contact with the restriction parts 63 of the lock member 23, the pair of side plates 86 are guided by the tapered faces 72*a* (refer to FIG. 8) of the pair of ribs 72 in a lower oblique direction to the inside of the left and right engagement plates 39 and 45. This makes easy to engage the positioning recess of the intermediate transferring unit 25 with the positioning projection 47 (refer to FIG. 6) of the process frame 21.

Then, as shown in FIG. 9, between the engagement part 62 of the lock member 23 and the side plate 86 of the intermediate transferring unit 25, the restriction part 63 of the lock member 23 is interposed. Because a gap between the restriction part 63 and the side plate 86 is very narrow, if the engagement part 62 is made to be moved in a direction in which the upper and lower claws 68 and 69 are separated from each of the left and right engagement plates 39 and 45, the pair of ribs 72 of the restriction part 63 come into contact with the side plate 86 to restrict the engagement part 62 from being moved. Furthermore, when the intermediate transferring unit 25 is attached to the process frame 21, if the lower edge of each side plates 86 comes into contact with the restriction part 63 of the lock member 23 and then the engagement part 62 is made to be moved in a direction in which the upper and lower claws 68 and 69 are separated from each of the left and right engagement plates 39 and 45, the restriction parts 63 are interfered with the side plates 86 so that the engagement parts 62 are not separated from the left and right engagement plates 39 and 45.

As described above, according to the color printer 1 of the present disclosure, the lock member 23 configured to position the drum unit 22 is formed with the restriction part 63. Accordingly, if the engagement part 62 is made to be moved in a direction separated from the process frame 21, the restriction part 63 is interfered with the intermediate transferring unit 25 to prevent the moving of the engagement part 62. Accordingly, it becomes possible to prevent the detachment of the lock member 23 from the process frame 21 and to position the drum unit 22 to the process frame 21 stably by the lock members 23.

In addition, when the intermediate transferring unit 25 is attached to the process frame 21 from the above side of the drum units 22, the lower edges of the pair of side plates 86 of the intermediate transferring unit 25 are guided along the tapered faces 72*a* of the pair of ribs 72 in an lower oblique direction to the inside of the left and right engagement plates 39 and 45. Thereby, it becomes possible to engage the positioning recess of the intermediate transferring unit 25 with the positioning projection 47 of the process frame 21 easily.

In addition, when the drum unit 22 is attached to the process frame 21 by using the lock members 23, the rotating shaft 56 of the photosensitive drum 51 is biased by the coil spring 91 to be engaged with the positioning portion 43*a*. When the rotating shaft 56 is engaged with the positioning portion 43*a*, the rotating shaft 56 is restricted from being moved upward by the coil spring 91 and the lock member 23. Accordingly, it becomes possible to position the rotating shaft 56 stably.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

a plurality of drum units, each of the drum units rotatably supporting a rotating shaft of a photosensitive drum;

a process frame having an attachment part to which each of the drum units is attached;

a lock member which is provided to both end portions of the rotating shaft for each drum unit and positions the drum unit to the attachment part; and an intermediate transferring unit attached to the process frame after the drum units are attached, wherein the lock member includes:

a supporting part through which an end of the rotating shaft is passed;

an engagement part engaged with the process frame between the process frame and the intermediate transferring unit; and a restriction part which interferes with the intermediate transferring unit between the engagement part and the intermediate transferring unit to prevent the engagement part from being detached from the process frame.

2. The image forming apparatus according to claim 1, wherein the lock member has a guide part which guides the intermediate transferring unit to the process frame.

3. The image forming apparatus according to claim 1, wherein the process frame has a positioning portion to which the rotating shaft is positioned, and the lock member has a biasing member which biases the rotating shaft to the positioning portion.

4. The image forming apparatus according to claim 1, wherein the restriction part is a pair of vertical ribs protruding toward the intermediate transferring unit from the engagement part.

5. The image forming apparatus according to claim 1, wherein the lock member has a pair of flange portions extending in opposing directions in a direction perpendicular to an axis direction of the rotating shaft and coming into contact with the drum unit.

6. An image forming apparatus comprising:

a plurality of drum units, each of the drum units rotatably supporting a rotating shaft of a photosensitive drum;

a process frame having an attachment part to which each of the drum units is attached;

a lock member which is provided for each drum unit and positions the drum unit to the attachment part; and an intermediate transferring unit attached to the process frame after the drum units are attached, wherein the lock member includes:

a supporting part through which an end of the rotating shaft is passed;

an engagement part engaged with the process frame between the process frame and the intermediate transferring unit; and a restriction part which interferes with the intermediate transferring unit between the engagement part and the intermediate transferring unit to prevent the engagement part from being detached from the process frame, wherein the engagement part is a pair of upper and lower claws protruding toward the process frame and engaged with the process frame so as to be movable in the vertical direction.

7. The image forming apparatus according to claim 3, wherein the positioning portion has an inverse trapezoidal shape tapered downward.

8. The image forming apparatus according to claim 6, wherein the lock members are provided to both end portions of the rotating shaft.

9. The image forming apparatus according to claim 1, wherein the drum unit is attached along a direction perpendicular to an axial direction of the rotating shaft, and the intermediate transferring unit is attached along the direction perpendicular to the axial direction of the rotating shaft.

10. The image forming apparatus according to claim 6, wherein the lock member has a guide part which guides the intermediate transferring unit to the process frame.

11. The image forming apparatus according to claim 6, wherein the process frame has a positioning portion to which the rotating shaft is positioned, and the lock member has a biasing member which biases the rotating shaft to the positioning portion.

12. The image forming apparatus according to claim 6, wherein the restriction part is a pair of vertical ribs protruding toward the intermediate transferring unit from the engagement part.

13. The image forming apparatus according to claim 6, wherein the lock member has a pair of flange portions extending in opposing directions in a direction perpendicular to an axis direction of the rotating shaft and coming into contact with the drum unit.

14. The image forming apparatus according to claim 11, wherein the positioning portion has an inverse trapezoidal shape tapered downward.

15. The image forming apparatus according to claim 6, wherein the drum unit is attached along a direction perpendicular to an axial direction of the rotating shaft, and the intermediate transferring unit is attached along the direction perpendicular to the axial direction of the rotating shaft.

* * * * *